US005171973A

United States Patent [19]

Higgins

[11] Patent Number: 5,171,973

[45] Date of Patent: Dec. 15, 1992

[54] RADIANT ELECTRIC HEATERS

[75] Inventor: George A. Higgins, Hagley, England

[73] Assignee: Ceramaspeed Limited, Droitwich, United Kingdom

[21] Appl. No.: 822,324

[22] Filed: Jan. 16, 1992

[30] Foreign Application Priority Data

Jan. 31, 1991 [GB] United Kingdom ..... 9102133

[51] Int. Cl.[5] ..... H05B 3/74

[52] U.S. Cl. ..... 219/464; 219/446; 219/448

[58] Field of Search ..... 219/445, 446, 448, 449, 219/464, 465, 483, 486

[56] References Cited

U.S. PATENT DOCUMENTS

| | | | |
|---|---|---|---|
| 2,207,871 | 7/1940 | Myers | 219/446 |
| 2,329,417 | 9/1943 | Pearce | 219/446 |
| 2,379,509 | 7/1945 | Elmer | 219/446 |
| 2,409,414 | 10/1946 | Bletz | 219/446 |
| 2,819,371 | 1/1958 | Aldrich | 219/445 |
| 2,900,480 | 8/1959 | Jordan . | |
| 3,017,489 | 1/1962 | Andrews | 219/445 |
| 3,069,526 | 12/1962 | Bremer | 219/449 |
| 3,172,997 | 3/1965 | Wetzel | 219/448 |
| 3,591,769 | 7/1971 | Manecke | 219/494 |
| 4,700,051 | 10/1987 | Goessler | 219/464 |
| 4,758,710 | 7/1988 | Grossley | 219/446 |
| 4,778,978 | 10/1988 | Schreder | 219/464 |
| 4,864,104 | 9/1989 | Crossley | 219/464 |

FOREIGN PATENT DOCUMENTS

| | | |
|---|---|---|
| 522930 | 7/1940 | United Kingdom . |
| 575654 | 2/1946 | United Kingdom . |
| 2132060 | 6/1984 | United Kingdom . |

*Primary Examiner*—Teresa J. Walberg
*Attorney, Agent, or Firm*—Ira S. Dorman

[57] ABSTRACT

A radiant electric heater arrangement for connection to a power supply system providing first and second different power supply voltages, for example 120 volts and 240 volts, includes a heater having at least first and second heating elements, a rectifier and a switch coupled to the heating elements and to the rectifier. The switch is able to couple the heating elements and the rectifier in a number of different configurations including (a) coupling the heating elements selectively in series and in parallel with one another; (b) coupling the heating elements selectively to the first and second power supply voltages; and (c) coupling the rectifier selectively in series with at least one of the heating elements, thus providing a plurality of user selected power output levels of the heater. Where three or more heating elements are provided, at least one of the heating elements is preferably an infra-red lamp.

11 Claims, 4 Drawing Sheets

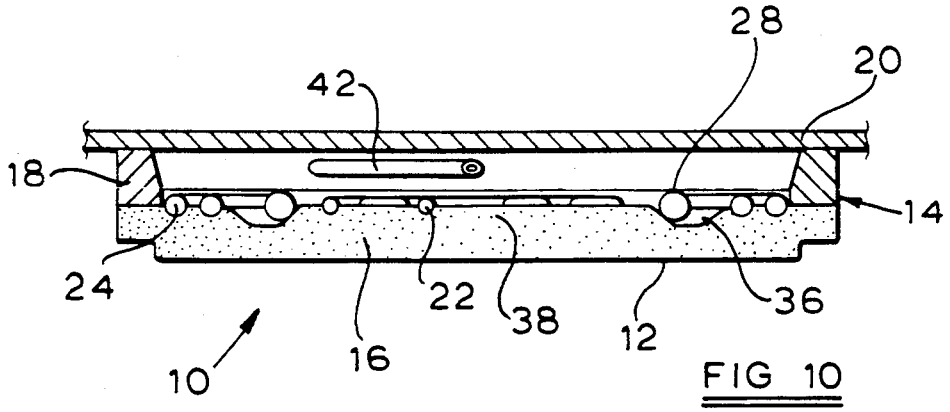
FIG 10
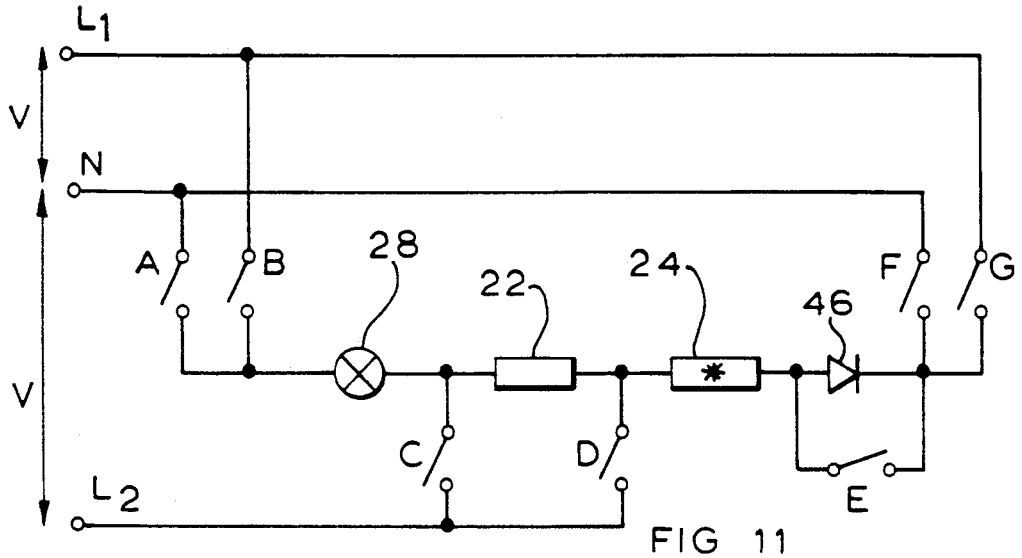
FIG 11
FIG 12
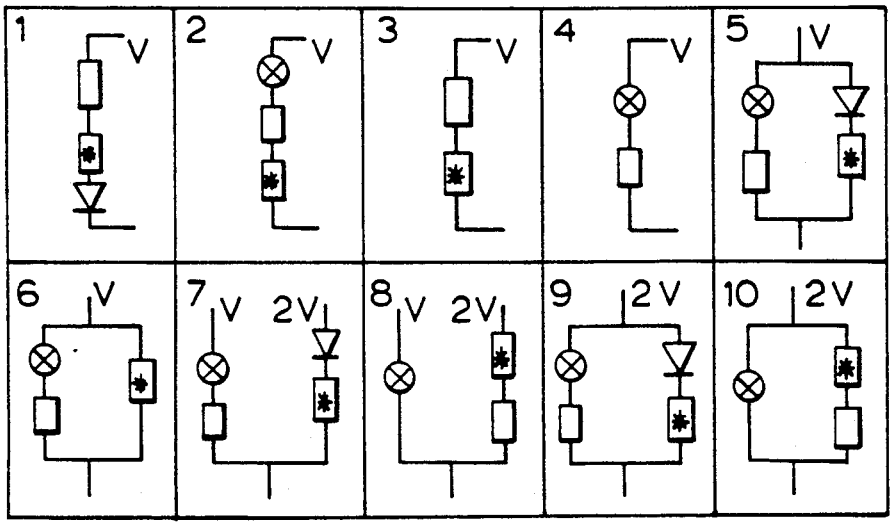

RADIANT ELECTRIC HEATERS

This invention relates to an arrangement of a radiant electric heater and switch means, which arrangement is for connection to a power supply system providing at least two different power supply voltages.

BACKGROUND OF THE INVENTION

Radiant electric heaters are known in which one or more heating elements are supported on or above a layer of thermal insulation material compacted in a metal support dish. Heaters of this kind are described, for example, in GB-A-1 580 909 (in which the heating element comprises coiled bare electric resistance wire) and EP-A-0 117 346 and GB-A-2 146 431 (in which the heating element comprises one or more infra-red lamps). Such heaters are typically incorporated in cookers, cooktops and other heating appliances having a flat, glass-ceramic cooking/heating surface.

Different power levels are provided, in one known technique, by including two or more heating elements in the heater, with a switch arranged to couple the elements into different series and/or parallel configurations in different switch positions.

In designing such heaters various different and possibly conflicting requirements must be accommodated. The resistances of the different heating elements must be chosen so that differing combinations of the elements produce power levels which together form an appropriately distributed sequence between zero and full power. In particular it has been found generally desirable to include a very low power level, of the order of 5% of full power. Where possible the intensity of visible light radiation produced by the energized elements at each power setting should be indicative of the power level at that setting; in addition it may be desirable that one or more elements should be energized sufficiently to produce some visible radiation for as many power settings as possible, to provide assurance to the user that the heater is functioning. This is particularly the case for any infra-red lamp heating element that may be included in the heater; the presence of an infra-red lamp element in an appliance typically results a premium price, so the user is likely to expect that element to be visibly in use.

The values of resistance that are chosen for the elements to suit these requirements will (in the case of coiled resistance wire elements) involve corresponding lengths (typically of the order of several meters) of resistance wire to provide those resistance values. These lengths of wire must be accommodated in the relatively confined space of the heater unit in such a way that electrical insulation constraints are satisfied, and so that an appropriate distribution of heat is obtained for each power level setting together with an aesthetically pleasing appearance.

In the case of heaters with infra-red lamps there is an additional constraint of limiting the number of lamps required, in view of their relatively high cost. This in turn limits the number of different series/parallel configurations in which the lamps can be connected.

Another way of providing switched power levels is possible in those countries, such as Germany and USA, where domestic electricity supplies typically comprise more than one phase of a multi-phase power distribution system. In this case it is possible to connect a heating element either between the line for one supply phase and neutral to obtain a first power level, or between the lines for two different phases to obtain a second, higher power level. An arrangement of this kind is described in U.S. Pat. No. 2,900,480.

Arrangements for switching the power level of radiant heaters currently provide a total of six different power levels plus off, using for example three heating elements. Nonetheless, it is believed that a need exists for switching arrangements providing a larger number of user-selectable power levels. However simple extension of the techniques already in use is not feasible, because for example the required number of heating elements could not practically be accommodated.

OBJECT OF THE INVENTION

It is an object of this invention to provide a radiant heater arrangement incorporating switch means for power level selection and which provides an increased range of power levels.

SUMMARY OF THE INVENTION

According to the present invention there is provided a radiant electric heater arrangement for connection to a power supply system providing first and second different power supply voltages, comprising:

a heater having at least first and second heating elements;

rectifier means; and switch means coupled to the at least first and second heating elements and to the rectifier means and arranged;

to couple the at least first and second heating elements selectively in series and in parallel with one another;

to couple the at least first and second heating elements selectively to the first and second power supply voltages; and to couple the rectifier means selectively in series with at least one of the at least first and second heating elements, whereby to provide a plurality of user selected power output levels of the heater.

In one embodiment the radiant electric heater arrangement includes first and second heating elements. The first and second heating elements may be rated such that one of the heating elements is rated at substantially 60 per cent of the total rated power of the heater and the other of the heater elements is rated at substantially 40 per cent of the total rated power of the heater. The heating elements may comprise coils of bare resistance wire.

The switch means may be arranged at least to couple the first and second heating elements in parallel with one another in at least the following circuit arrangements:

a) the first heating element is connected to the first supply voltage and the second heating element is connected to the second supply voltage; and b) the second heating element is connected to the first supply voltage and the first heating element is connected to the second supply voltage.

In another embodiment the radiant electric heater arrangement includes first, second and third heating elements. The first and second heating elements may comprise coils of bare resistance wire and the third heating element may comprise an infra-red lamp. The power output level of the third heating element preferably increases with increasing power output level of the heater.

The switch means may be arranged to couple the heating elements in at least the following circuit arrangements:

a) the first heating element in series with the third heating element and connected to one of the first and second power supply voltages, and the second heating element in series with the rectifier and connected to the second power supply voltage;

b) the third heating element connected to one of the first and second power supply voltages, and the first and second heating elements in series with one another and connected to the second power supply voltage;

c) the first, second and third heating elements in series and connected to one of the first and second power supply voltages; and d) the first, second and third heating elements and the rectifier in series and connected to one of the first and second power supply voltages.

Alternatively, the switch means may be arranged to couple the heating elements in at least the following circuit arrangements:

a) the first heating element in series with the second heating element and connected to the second power supply voltage, and the third heating element connected to one of the first and second power supply voltages; and b) the first and third heating element in series and connected to one of the first and second power supply voltages, and the second heating element and the rectifier in series and connected to the second power supply voltage.

The switch means may be arranged to couple the heating elements in at least the following further circuit arrangements:

a) the first and third heating elements in series and connected to the first power supply voltage, and the second heating element in series with the rectifier and connected to the first power supply voltage;

b) the first and third heating elements in series and connected to the first power supply voltage, and the second heating element connected to the first power supply voltage.

For a better understanding of the present invention and to show more clearly how it may be carried into effect reference will now be made, by way of example, to the accompanying drawings in which:

BRIEF DESCRIPTION OF THE DRAWINGS

FIG. 10 is a cross-sectional view of the heater shown in FIG. 9, taken along the line X—X;

FIG. 11 is a circuit diagram of switch means for controlling the power level of the heater of FIGS. 9 and 10; and FIG. 12 is a schematic illustration of the circuit arrangement which exists for each state of the switch means shown in the circuit diagram of FIG. 11.

DESCRIPTION OF PREFERRED EMBODIMENTS

Figure 1:
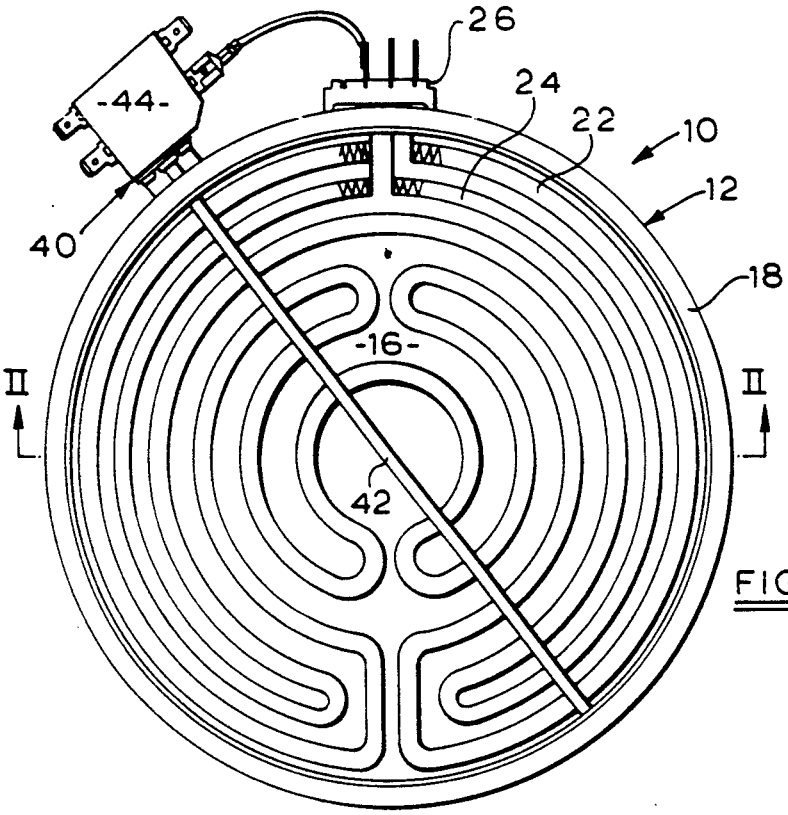
FIG. 1 is a plan view of a first embodiment of a radiant heater.
Figure 2:
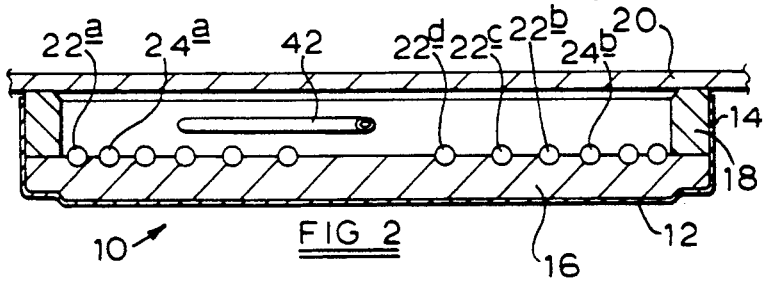
FIG. 2 is a cross-sectional view of the heater shown in FIG. 1, taken along the line II—II.

Referring to FIGS. 1 and 2, a radiant electric heater 10 has a container in the form of a metal dish 12 with an upstanding rim 14 and containing a layer of electrical and thermal insulating material 16. This material is for example a microporous insulation which is compressed into the dish 12, and which comprises a highly-dispersed silica powder, such as silica aerogel or pyrogenic (fumed) silica, mixed with ceramic fibre reinforcement, titanium dioxide opacifier and a small quantity of alumina powder to resist shrinkage. A ring-shaped wall 18 of ceramic fibre extends around the inside of the rim 14 of the dish 12, on top of the layer 16 and protruding slightly above the edge of the rim 14. When installed in a glass ceramic top cooker the wall 18 is pressed against the underside of a glass ceramic cooking surface, shown in dashed outline at 20 in FIG. 2, the heater 10 being held in position by a spring or other mounting device (not shown). Prior to installation the wall 18 may be retained in position by staples (not shown) extending into the layer 16.

The layer 16 supports two coiled bare resistance-wire heating elements 22 and 24 arranged in multiple concentric, generally circular portions 22*a*, 22*b*, 22*c*, 22*d* and 24*a* and 24*b* within and adjacent the wall 18. The coiled elements 22 and 24 are secured to the layer 16 by, for example, staples held by friction in the insulating material of the layer 16, or by gluing to the layer 16 or to stakes inserted therein. The ends of the heating element portions 22 and 24 are coupled to respective conductors in an electrical connector block 26 mounted at the edge of the dish 12.

As is customary with heaters for glass ceramic top cookers, a temperature sensitive rod limiter 40 is provided with its probe 42 extending across the heater 10. This probe typically comprises a fused silica tube containing a metal rod. A snap-action switch 44 controlled by the probe 42 is provided for connection in series with the heating elements 22 and 24, to prevent heating of the cooktop 20 above its maximum safe temperature. The limiter switch 44 is connected to the ends of the two heating elements 22 and 24.

When the heater 10 is installed in a cooking or heating apparatus together with a multi-position control switch, it can be controlled to provide ten different heating power levels by connection of the heating elements 22 and 24 in different series and parallel combinations. In order to provide the ten different heating power levels the heating elements 22 and 24 have different power ratings, with heating element 22 being rated at substantially 60 per cent of the total power of the heater and heating element 24 being rated at substantially 40 per cent of the total power of the heater. Thus, for a heater rated at 1700 watts the heating element 22 may be rated at 1040 watts and the heating element 24 rated at 660 watts.

Figure 3:
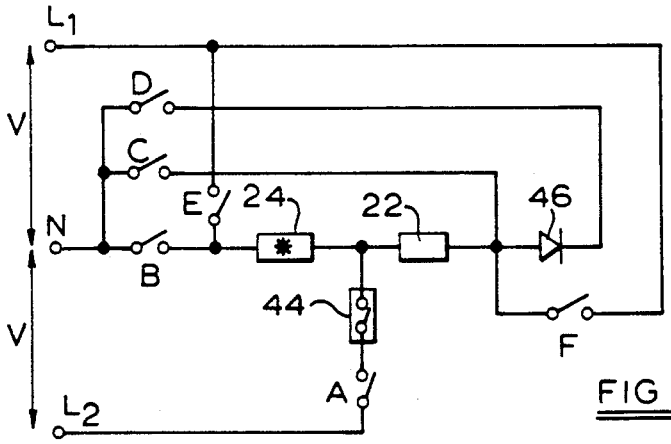
FIG. 3 is a circuit diagram of switch means for controlling the power level of the heater of FIGS. 1 and 2.

Referring to FIG. 3, the heating elements 22 and 24 and the limiter switch 44 of FIG. 1 are represented schematically and identified by the same reference numerals. Also shown are six switch contacts A to F of a six pole, eleven-way switch which is provided for the user to control the heater power level, and a rectifier 46, which can conveniently be mounted in proximity to the switch and is used selectively to block half-cycles of a.c. power supply current to provide some of the desired heating power levels. Table 1 below shows which switch contacts are closed for each user-selected position of the control switch; in the eleventh (off) position all contacts are open.

TABLE 1

| | 1 | 2 | 3 | 4 | 5 | 6 | 7 | 8 | 9 | 10 |
|---|---|---|---|---|---|---|---|---|---|---|
| A | | | X | X | X | X | X | X | X | X |
| B | | | | X | | X | | | X | |
| C | | X | | | X | X | | X | | |
| D | X | | X | | | | | | | |
| E | X | X | | | | | X | X | | X |
| F | | | | | | | | | X | X |

X = contact closed

Additional contacts may be provided for double-pole isolation and/or to provide a signal switch, for example too provide a pilot light indication that the heater is energised.

Figure 4:
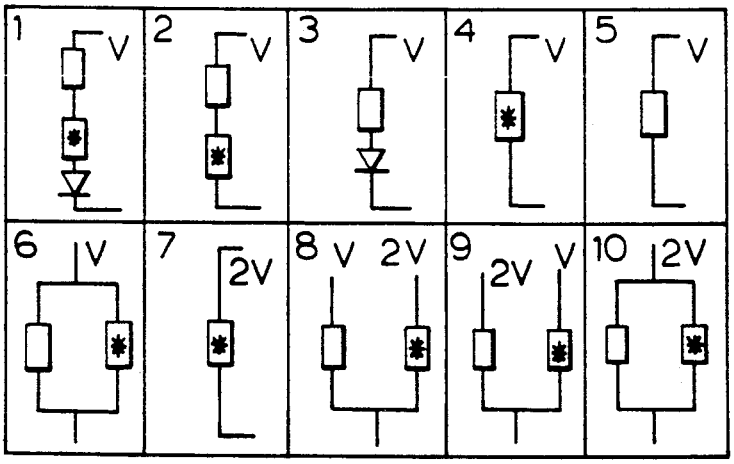
FIG. 4 is a schematic illustration of the circuit arrangement which exists for each state of the switch means shown in the circuit diagram of FIG. 3.

FIG. 4 indicates schematically which of the heating elements are actively includes in the circuit for each switch position; for clarity the heating element 24 is identified in FIG. 4, and also in FIG. 3, by an asterisk.

The circuit shown in FIG. 3 is intended to be coupled to a two-phase a.c. electricity supply having a neutral line N and two live lines $L_1$ and $L_2$. The lines $L_1$ and $L_2$ are each at a voltage V (typically 120 volts) relative to the neutral line N; in addition the phase relationship between the lines $L_1$ and $L_2$ is such that they are at a voltage 2 V (typically 240 ) relative to one another.

The switch contacts are connected as follows:

A: between the live line $L_2$ and the limiter switch 44;

B: between the neutral line N and the heating element 24;

C: between the neutral line N and the junction of the heating element 22 and the rectifier 46;

D: between the neutral line N and rectifier 46, which is itself connected in series with the heating element 22;

E: between the live line $L_1$ and the heating element 24; and

F: between the live line $L_1$ and the junction between the heating element 22 and the rectifier 46.

In switch position 1 (the lowest power setting), both heating elements 22 and 24 are connected in series, and in series with the rectifier 46 (se FIG. 4). Switch position 2 is similar to switch position 1, but without the rectifier 46; thus both half-cycles of the a.c. supply are passed by the circuit, and the power dissipation is correspondingly higher. In switch position 3 the heating element 24 is omitted from the circuit and the heating element 22 is connected in series with the rectifier 46. In switch position 4 the heating element 24 is used alone, while in switch position 5 the heating element 22 is used alone. In switch position 6 the heating elements 22 and 24 are connected in parallel. In switch positions 1 and 2 current is taken solely via the live line $L_1$ and the neutral line (switch contacts C, D and E), while in switch positions 3 to 6 current is taken solely via the live line $L_2$ and the neutral line N (switch contacts A, B, C and D), in each case at a voltage V.

The circuit in switch position 7 is the same as in position 4, but with the current taken via the live lines $L_1$ and $L_2$ (switch contacts A and E), at a voltage 2 V.

In switch position 8 the heating element 22 is supplied with current via the live line $L_2$ and the neutral line N (switch contacts A and C), at a voltage V, and the heating element 24 is supplied with current via the live lines $L_1$ and $L_2$ (switch contacts A and E), at a voltage 2 V.

For switch position 9 the heating element 24 is supplied with current via the live line $L_2$ and the neutral line N (switch contacts A and B), at a voltage V, and the heating element 22 is supplied with current via the live lines $L_1$ and $L_2$ (switch contacts A and F), at a voltage 2 V.

For switch position 10 all current is supplied to the heating elements 22 and 24 in parallel via the live lines $L_1$ *and* $L_2$ at a voltage 2 V; to this end the switch contacts A, E and F are all closed.

Thus the arrangement shown and described in FIGS. 1 to 4 provides the advantage of ten different settings with only two heating elements and a rectifier. In particular, the selective connection of heating element 22 either in series with the heating element 24 (switch positions 1 and 2) or in parallel with the heating element 24 (switch positions 6, 8, 9 and 10), in conjunction with the ability to use either of the heating elements alone provides considerable flexibility of circuit arrangement.

It will be noted that in two of the switch positions (1 and and 2) the limiter switch 44 is by-passed. However, for these two switch positions the current by-passing the limiter switch 44 is at a relatively low level and is unlikely to cause the glass ceramic cooktop 20 to attain its maximum rated temperature, even in abuse conditions.

Various modifications are possible to the arrangement as described. Thus, for example, one or more of the switch positions may be omitted to provide fewer switch positions at lower cost.

Figure 5:
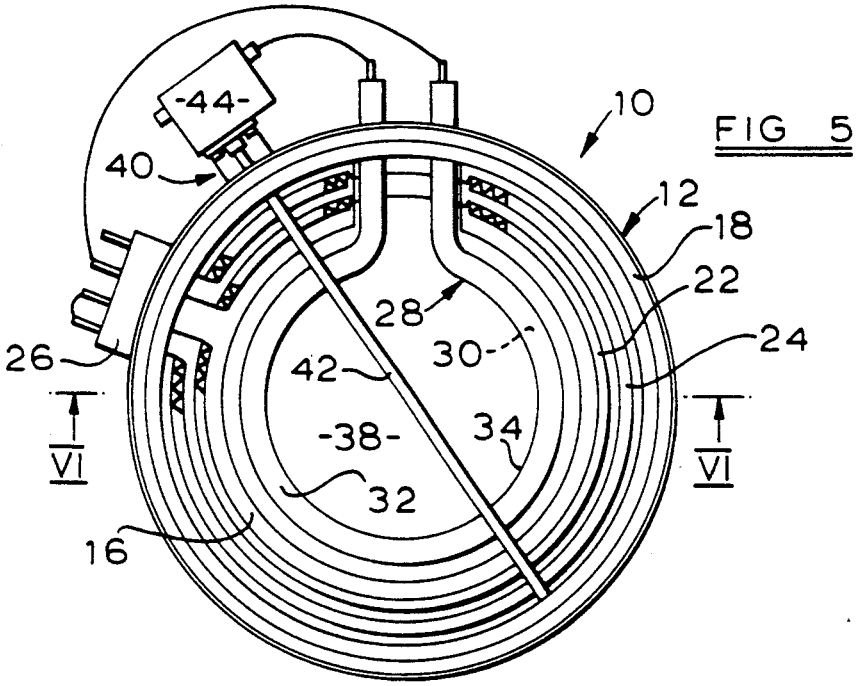
FIG. 5 is a plan view of a second embodiment of a radiant heater.
Figure 6:
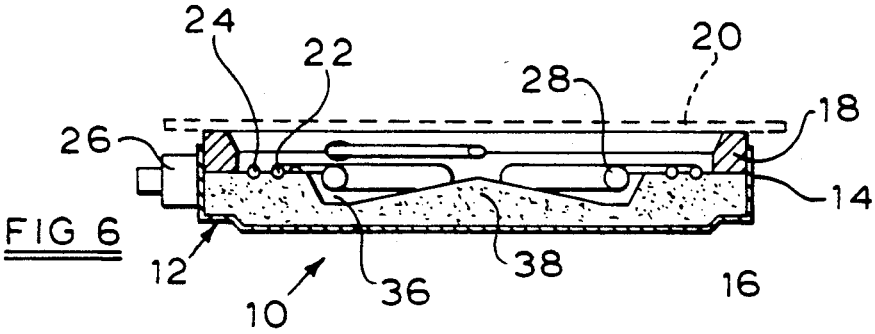
FIG. 6 is a cross-sectional view of the heater shown in FIG. 5, taken along the line VI—VI.

The radiant electric heater shown in FIGS. 5 and 6 is similar to that shown in FIGS. 1 and 2 and the same reference numerals are used to denote the same or similar components. In addition to the heating elements 22 and 24, the heater shown in FIGS. 5 and 6 an additional heating element in the form of a tungsten-halogen infrared lamp 28. This lamp is geneally circular in configuration and arranged concentrically within the wire heating elements 22 and 24, and contains a tungsten filament 30 supported approximately axially on spacers 32 within an infra-red transmissive fused silica envelope 34. These spacers are arranged closely enough together to maintain the filament 30 at the desired distance from its envelope 34 in between each pair of spacers 32 despite the curvature of the envelope 34. The filament 30 is secured at each end to connections brought out through flattened hermetic pinch seals at the ends of the envelope 34. These ends are adjacent one another, and the pinch seals extend generally radially of the heater 10 through recesses provided in the underside of the peripheral wall 18 and in the layer 16, and through holes in the rim 14 of the dish 12.

The surface of the layer 16 is contoured, as shown in FIG. 6, to reduce the concentration of heat on the glass ceramic cooking surface 20 immediately above the lamp 28, and to maintain an adequate thickness for the layer 16. Thus under the lamp 28 there is an annular depression 36. Although the presence of this depression also helps to minimise the overall height of the heater 10, it is considerably broader than is required for this purpose alone. The central region 38 of the layer 16, within the lamp 28, is made slightly convex.

The lamp 28 is restrained against movement by its ends and by, for example, a clip (not shown) engaging it mid-way along its envelope 34 and secured to the insulating layer 16. Further details of this and other methods of supporting the lamp are given in patent specification GB-A-2 220 333/EP-A-0 343 868.

The limiter switch 44 in the embodiment of FIGS. 5 and 6 is connected to one terminal of the lamp 28, the other terminal of which is connected to one end of the heating element 22. The second end of the heating element 22 is connected to the other heating element 24. Because one of the heating elements is in the form of an infra-red lamp 28, the rod of the temperature limiter 40 is preferably plated with a reflective material, such as silver, as described in GB-A-2 146 431.

When the heater 10 is installed in a cooking or heating apparatus together with a multi-position control switch, it can be controlled to provide ten different heating power levels by connection of the heating elements 22, 24 and 28 in different series and parallel combinations. In a heater rated at 1800 watts, for example, the lamp may be rated at 1000 to 1200 watts, with the heating elements 22 and 24 in series being rated at 800 to 600 watts.

Figure 7:
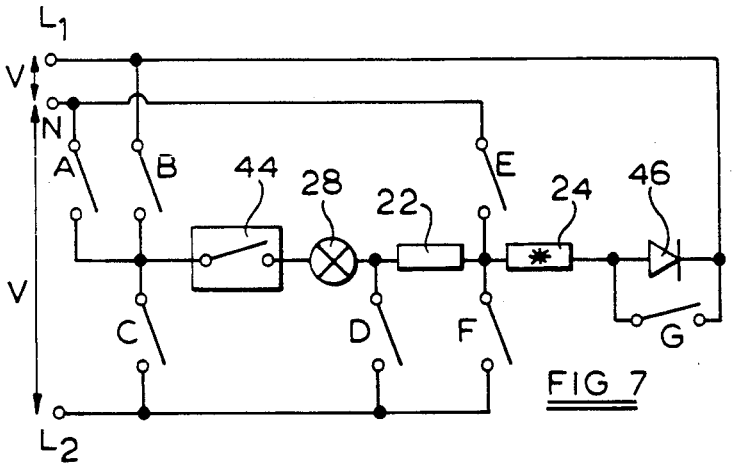
FIG. 7 is a circuit diagram of switch means for controlling the power level of the heater of FIGS. 5 and 6.

Referring to FIG. 7, the heating elements 22, 24 and 28 and the limiter switch 44 of FIG. 5 are represented schematically and identified by the same reference numerals. Also shown are seven switch contacts A to G of a seven pole, eleven-way switch which is provided for the user to control the heater power level, and rectifier 46, which can conveniently be mounted in proximity to the switch and is used selectively to block half-cycles of a.c. power supply current to provide some of the desired heating power levels. Table 2 below shows which switch contacts are closed for each user-selected position of the control switch; in the eleventh (off) position all contacts are open.

TABLE 2

| | 1 | 2 | 3 | 4 | 5 | 6 | 7 | 8 | 9 | 10 |
|---|---|---|---|---|---|---|---|---|---|---|
| A | X | | X | | | | X | X | | |
| B | | | | | | | | | X | X |
| C | | | | | X | X | | | | |
| D | | | | | | | | X | | X |
| E | | X | | X | | | | | | |
| F | | | | | | | X | | X | |
| G | | | X | X | | X | | X | | X |

X = contact closed

Figure 8:
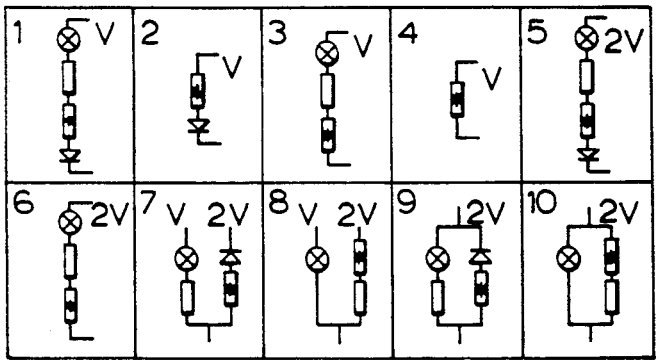
FIG. 8 is a schematic illustration of the circuit arrangement which exists for each state of the switch means shown in the circuit diagram of FIG. 7.

FIG. 8 indicates schematically which of the heating elements are actively included in the circuit for each switch position; for clarity the heating element 24 is identified in FIG. 8, and also in FIG. 7, by an asterisk.

The circuit shown in FIG. 7 is intended to be coupled to a two-phase a.c. electricity supply having a neutral line N and two live lines $L_1$ and $L_2$. The lines $L_1$ and $L_2$ are each at a voltage V (typically 120 volts) relative to the neutral line N; in addition the phase relationship between the lines $L_1$ and $L_2$ is such that they are at a voltage 2V (typically 240 volts) relative to one another.

The switch contacts are connected as follows:

A: between the neutral line N and the limiter switch 44;
B: between the live line $L_1$ and the limiter switch 44;
C: between the live line $L_2$ and the limiter switch 44;
D: between the live line $L_2$ and the junction of the lamp 28 and the heating element 22;
E: between the neutral line N and the junction between the heating elements 22 and 24;
F: between the live line $L_2$ and the junction between the heating elements 22 and 24; and
G: across the rectifier 46, which is itself connected between the heating element 24 and the live line $L_1$.

In switch position 1 (the lowest power setting), both heating elements 22 and 24 and the lamp 28 are connected in series, and in series with the rectifier 46 (see FIG. 8). In switch position 2, only the heating element 24 is used, in series with the rectifier; since the total circuit resistance is therefore lower than with both elements 22 and 24 and lamp 28 together, the power dissipation is higher. Similar arrangements are used in switch positions 3 and 4 as for positions 1 and 2 respectively, but without the rectifier 46; thus both half-cycles of the a.c. supply are passed by the circuit, and the power dissipation is correspondingly higher. In all four switch positions 1 to 4 current is taken solely via the live line $L_1$ and the neutral line N (switch contacts A or E), at a voltage V.

The circuits in positions 5 and 6 are the same as in positions 1 and 3 respectively, but with the current taken via the live lines $L_1$ and $L_2$ (switch contact C), at a voltage 2V.

In switch position 7 the lamp 28 and the heating element 22 are supplied with current via the live line $L_2$ and the neutral line N (switch contacts A and F), at a voltage V, and the heating element 24 is supplied with current via the live lines $L_1$ and $L_2$ (switch contact F), at a voltage 2V, and via the rectifier 46.

For switch position 8 the lamp alone is supplied with current via the live line $L_2$ and the neutral line N (switch contacts A and D), at a voltage V, and the heating elements 22 and 24 are connected in series and are supplied with current via the live lines $L_1$ and $L_2$ directly (switch contact D), at a voltage 2V.

The circuit arrangements for switch positions 9 and 10 are similar to those for positions 7 and 8, except that all current is supplied via the live lines $L_1$ and $L_2$ at a voltage 2V; to this end the switch contact B is closed instead of the switch contact A.

The arrangement shown and described in FIGS. 5 to 8 provides a number of advantages: the lamp 28 is in active use for all but two of the power level settings; the brightness of the lamp generally increases in line with power output of the heater, which is an important consideration when the lamp 28 is present; a total of ten different settings are provided with effectively only three heating elements 22, 24 and 28. In particular, the selective connection of heating element 22 either in series with the heating element 24 (switch positions 8 and 10) or in series with the lamp 28 (switch positions 7 and 9) provides considerable flexibility of circuit arrangement.

It will be noted that in two of the switch positions (2 and 4) the limiter switch 44 is completely by-passed, and in four switch positions (7 to 10) some of the heater current by-passes this switch. However, for all these switch positions the current by-passing the limiter switch 44 is at a relatively low level and is unlikely to cause the glass ceramic cooktop 20 to attain its maximum rated temperature, even in abuse conditions. In addition, this arrangement of the limiter switch 44 has the advantage of reducing and simplifying the wiring to the power level control switch. However, where by-passing of the limiter switch 44 is not desirable or acceptable the limiter switch 44 can be positioned elsewhere in the circuit.

Various modifications are possible to the arrangement as described. Thus, for example, the heating element 22 need not be energised in switch positions 8 and 10, so the heating element 24 is energised without the element 22 in series therewith. Furthermore, in switch position 5 the lamp 28 may be omitted from the circuit.

Figure 9:
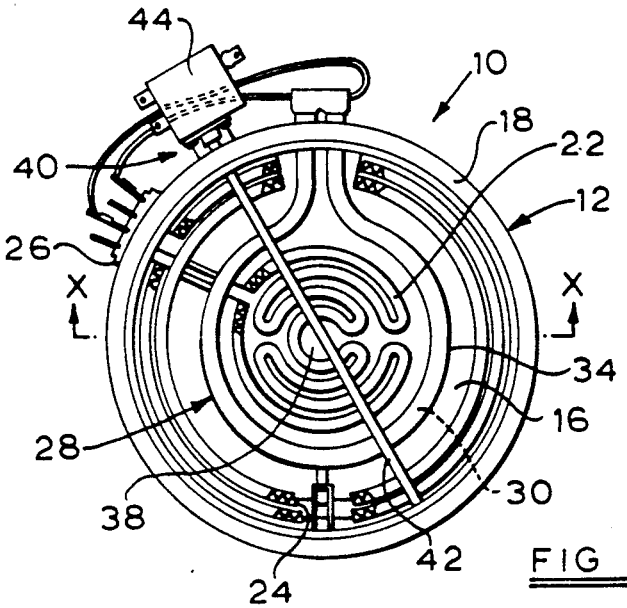
FIG. 9 is a plan view of a third embodiment of a radiant heater.

The radiant electric heater shown in FIGS. 9 and 10 is similar to that shown in FIGS. 5 and 6 and the same reference numerals are used to denote the same or similar components. The heater shown in FIGS. 9 and 10 is modification of the heater shown in FIGS. 5 and 6 in that the coiled wire heating elements 22 and 24 are located on either side of the lamp 28. In particular, the heating element 22 is located outside the lamp 28, adjacent the peripheral wall 18, and the heating element 24 is located on the central region 38 of the insulating layer 16.

Although there is an annular depression 36 under the lamp, in contrast to the heater shown in FIGS. 5 and 5 the central region 38 of the layer 16, within the lamp 28, is flat rather than slightly convex so as to accommodate the inner heating element 24.

In the embodiment of FIGS. 9 and 10, the heating element 22 is connected between one terminal of the lamp 28 and one end of the heating element 24. For convenience, the limiter switch 44 is not shown in the embodiment of FIGS. 9 and 10.

When the heater 10 is installed in a cooking or heating apparatus together with a multi-position control switch, it can be controlled to provide ten different heating power levels by connection of the heating elements 22, 24 and 28 in different series and parallel combinations.

Referring to FIG. 11, the heating elements 22, 24 and 28 of FIG. 9 are represented schematically and identified by the same reference numerals. Also shown are seven switch contacts A to G of a seven pole, eleven-way switch which is provided for the user to control the heater power level, and rectifier 46, which can conveniently be mounted in proximity to the switch and is used selectively to block half-cycles of a.c. power supply current to provide some of the desired heating power levels. Table 3 below shows which switch contacts are closed for each user-selected position of the control switch; in the eleventh (off) position all contacts are open.

TABLE 3

| | 1 | 2 | 3 | 4 | 5 | 6 | 7 | 8 | 9 | 10 |
|---|---|---|---|---|---|---|---|---|---|---|
| A | | | | X | X | X | X | X | | |
| B | | X | | | | | | | X | X |
| C | X | | X | | | | | X | | X |
| D | | | | X | X | X | X | | X | |
| E | | X | X | | | X | | X | | X |
| F | X | X | X | | X | X | | | | |
| G | | | | | | | X | X | X | X |

X = contact closed

FIG. 12 indicates schematically which of the heating elements are actively included in the circuit for each switch position; for clarity the heating element 24 is identified in FIG. 12, and also in FIG. 11, by an asterisk.

The circuit shown in FIG. 11 is intended to be coupled to a two-phase a.c. electricity supply having a neutral line N and two live lines $L_1$ and $L_2$. The lines $L_1$ and $L_2$ are each at a voltage V (typically 120 volts) relative to the neutral line N; in addition the phase relationship between the lines $L_1$ and $L_2$ is such that they are at a voltage 2V (typically 240 volts) relative to one another.

The switch contacts are connected as follows:

A: between the neutral line N and the lamp 28;

B: between the live line $L_1$ and the lamp 28;

C: between the live line $L_2$ and the junction between the lamp 28 and the heating element 24;

D: between the live line $L_2$ and the junction between the heating elements 22 and 24;

E: across the rectifier 46 which is itself connected to the heating element 24;

F: between the rectifier 46 and the neutral line N; and

G: between the rectifier 46 and the live line $L_1$.

In switch position 1 (the lowest power setting), both heating elements 22 and 24 are connected in series, and in series with the rectifier 46 (see FIG. 12). In switch position 2 both heating elements 22 and 24 are connected in series and are connected in series with the lamp 28, but without the rectifier 46; thus both half-cycles of the a.c. supply are passed by the circuit, and the power dissipation is correspondingly higher.

In switch position 3 only the heating elements 22 and 24 are connected in series; since the total circuit resistance is therefore lower than with both elements 22 and 24 and lamp 28 together, the power dissipation is higher. In switch position 4 the lamp 28 is connected in series with the heating element 22. The circuit in switch position 5 is similar to that in switch position 4 except that the heating element 24 is connected in series with the rectifier 46 and the combination of the heating element 24 and rectifier 46 is connected in parallel with the combination of the lamp 28 and the heating element 22. The circuit in switch position 6 is similar to that in switch position 5, except that the rectifier 46 is omitted (switch contact E).

In all six switch positions 1 to 6 current is taken solely via the live line $L_1$ or the live line $L_2$ and the neutral line N, at a voltage V.

In switch position 7 the lamp 28 is connected in series with the heating element 22 and the combination is supplied with current via the live line $L_2$ and the neutral line N (switch contacts A and D), at a voltage V, and the heating element 24 is connected in series with the rectifier 46 and this combination is supplied with current via the live lines $L_1$ and $L_2$ (switch contacts D and G), at a voltage 2V.

In switch position 8 the lamp 28 is supplied with current via the live line $L_2$ and the neutral line (switch contacts A and C), at a voltage V, and the heating elements 22 and 24 are connected in series and are supplied with current via the live lines $L_1$ and $L_2$ (switch contacts C, E and G), at a voltage 2 V.

Switch position 9 is similar to position 7, but with the lamp 28 and the heating element 22 supplied with current via the live lines $L_1$ and $L_2$ (switch contact B), at a voltage 2 V, while switch position 10 is similar to switch position 8, but with the lamp 28 supplied with current via the live lines $L_1$ and $L_2$ (switch contact B), at a voltage 2 V.

The arrangement shown and described in FIGS. 9 to 12 provides a number of advantages: the lamp 28 is in active use for all but two of the power level settings; the brightness of the lamp generally increases in line with power output of the heater in the top four settings; a total of ten different settings are provided with effectively only three heating elements 22, 24 and 28. In particular, the selective connection of heating element 22 either in series with the lamp 28 (switch positions 4, 5, 6, 7 and 9) or in series with the heating element 24 (switch positions 1, 3, 8 and 10) provides considerable flexibility of circuit arrangement.

In addition, or as an alternative, to the circuit arrangement is switch position 1 a lower power arrangement can be provided if the lamp 28 is connected in series with both the heating elements 22 and 24 and with the rectifier 46 and supplied with current via the live line $L_1$ and the neutral line N, at a voltage V.

In other embodiments of the invention (not illustrated), either the position of the two heating elements 22 and 24 in FIGS. 9 and 10 can be swapped or both heating elements 22 and 24 can be located inside the area surrounded by the lamp 28.

I claim:

1. A radiant electric heater arrangement for connection to a power supply system providing first and second different voltages, comprising:

a heater having at least first and second heating elements;

rectifier means;

manually operable switch means coupled to the at least first and second heating elements and to the rectifier means for manually selecting any one of plurality of substantially constant different power settings and arranged:

to couple the at least first and second heating elements selectively in series and in parallel with one another to form a plurality of combined heating elements, and to couple at least one of the combined heating elements selectively across the first and second different power supply voltages;

to couple one of the at least first and second heating elements independently of any coupling of the other or others of the at least first and second heating elements selectively across the first and second different power supply voltages; and to couple the rectifier means selectively in series with at least one of the at least first and second heating elements.

2. A radiant electric heater arrangement for connection to a power supply system providing first and second different voltages, comprising:

a heater having at least first and second heating elements;

rectifier means;

manually operable switch means coupled to the first and second heating elements and to the rectifier means for manually selecting any one of a plurality of substantially constant different power settings and arranged:

to couple the at least first and second heating elements selectively in series and in parallel with one another to form a plurality of combined heating elements, and to couple at least one of the combined heating elements selectively across the first and second different power supply voltages;

to couple the first and second heating elements independently and selectively across the first and second different power supply voltages; and to couple the rectifier means selectively in series with at least one of the at least first and second heating elements.

3. A radiant electric heater arrangement as claimed in claim 2, wherein the first and second heating elements are rated such that one of the heating elements is rated at substantially 60 percent of the total rated power of the heater and the other of the heater elements is rated at substantially 40 percent of the total rated power of the heater.

4. A radiant electric heater arrangement as claimed in claim 2, wherein the heating elements comprise coils of bare resistance wire.

5. A radiant electric heater arrangement as claimed in claim 2, wherein the manually operable switch means is arranged to couple the first and second heating elements independently and selectively to the first and second different power supply voltages in at least the following circuit arrangements:

a) the first heating element is connected to the first power supply voltage and the second heating element is connected to the second supply voltage; and b) the second heating element is connected to the first supply voltage and the first heating element is connected to the second supply voltage.

6. A radiant electric heater arrangement for connection to a power supply system providing first and second different voltages, comprising:

a heater having at least first, second and third heating elements;

rectifier means;

manually operable switch means coupled to the heating elements and to the rectifier means for manually selecting any one of plurality of substantially constant different power settings and arranged:

to couple at least two of the first, second and third heating elements selectively in series and in parallel with one another to form a plurality of combined heating elements, and to couple at least one of the combined heating elements selectively across the first and second different power supply voltages;

to couple one of the first, second and third heating elements independently of any coupling of the others of the first, second and third heating elements selectively across the first and second different power supply voltages; and to couple the rectifier means selectively in series with at least one of the heating elements.

7. A radiant electric heater arrangement as claimed in claim 6, wherein the first and second heating elements comprise coils of bare resistance wire and the third heating element comprises an infra-red lamp.

8. A radiant electric heater arrangement as claimed in claim 7, wherein the power output level of the third heating element increases with increasing power output level of the heater.

9. A radiant electric heater arrangement as claimed in claim 6, wherein the switch means is arranged to couple the heating elements in at least the following circuit arrangements:

a) the first heating element in series with the third heating element and connected to one of the first and second power supply voltages, and the second heating element in series with the rectifier and connected to the second power supply voltage;

b) the third heating element connected to one of the first and second power supply voltages, and the first and second heating elements in series with one another and connected to the second power supply voltage;

c) the first, second and third heatings elements in series and connected to one of the first and second power supply voltages; and d) the first, second and third heating elements and the rectifier in series and connected to one of the first and second power supply voltages.

10. A radiant electric heater arrangement as claimed in claim 6, wherein the switch means is arranged to couple the heating elements in at least the following circuit arrangements:

a) the first heating element in series with the second heating element and connected to the second power supply voltage, and the third heating element connected to one of the first and second power supply voltages; and b) the first and third heating element in series and connected to one of the first and second power supply voltages, and the second heating element and the rectifier in series and connected to the second power supply voltage.

11. A radiant electric heater arrangement as claimed in claim 10, wherein the switch means is arranged to couple the heating elements in at least the following further circuit arrangements:

a) the first and third heating elements in series and connected to the first power supply voltage, and the second heating element in series with the rectifier and connected to the first power supply voltage;

b) the first and third heating elements in series and connected to the first power supply voltage, and the second heating element connected to the first power supply voltage.

* * * * *